US008160485B2

(12) United States Patent
Hayase

(10) Patent No.: US 8,160,485 B2
(45) Date of Patent: Apr. 17, 2012

(54) FIXING DEVICE AND IMAGE FORMING DEVICE

(75) Inventor: Toru Hayase, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 60 days.

(21) Appl. No.: 12/780,000

(22) Filed: May 14, 2010

(65) Prior Publication Data

US 2010/0303526 A1 Dec. 2, 2010

(30) Foreign Application Priority Data

May 28, 2009 (JP) ..... 2009-128540

(51) Int. Cl.
*G03G 15/20* (2006.01)

(52) U.S. Cl. ..... 399/329; 399/330; 219/216

(58) Field of Classification Search ..... 399/122, 399/320, 328–331; 219/216, 244
See application file for complete search history.

(56) References Cited

U.S. PATENT DOCUMENTS

| | | | | |
|---|---|---|---|---|
| 2005/0141932 | A1* | 6/2005 | Sugiyama | 399/328 |
| 2005/0185996 | A1* | 8/2005 | Oishi et al. | 399/329 |
| 2007/0048044 | A1* | 3/2007 | Tokuhiro et al. | 399/329 |
| 2009/0052925 | A1 | 2/2009 | Fujimoto | |
| 2009/0074485 | A1 | 3/2009 | Takada | |

FOREIGN PATENT DOCUMENTS

| | | | |
|---|---|---|---|
| EP | 1925989 | A2 | 5/2008 |
| JP | 8-137310 | A | 5/1996 |
| JP | 11-231704 | A | 8/1999 |
| JP | 2002-372887 | | 12/2002 |
| JP | 2003-005553 | | 1/2003 |
| JP | 2005-4126 | A | 1/2005 |
| JP | 2009-109932 | | 5/2009 |
| JP | 2009109932 | A * | 5/2009 |

OTHER PUBLICATIONS

Office Action (Notification of Reasons for Refusal) dated May 10, 2011, issued in the corresponding Japanese Patent Application No. 2009-128540, and an English Translation thereof.

European Search Report issued in corresponding European Patent Application No. 10164054.8, mailed Sep. 13, 2010.

Decision to Grant issued in corresponding Japanese Patent Application No. 2009-128540, mailed Dec. 27, 2011, and English Translation.

* cited by examiner

*Primary Examiner* — David Porta
*Assistant Examiner* — B. S.
(74) *Attorney, Agent, or Firm* — Buchanan Ingersoll & Rooney PC

(57) ABSTRACT

A fixing device includes: a pressure belt movable in a revolving motion; a fixing roller; and a pressure member for pressing an inner surface of the belt toward the roller. A fixing nip is formed between the roller and the belt while an elastically deformable surface of the roller is contacted with the belt by pressure applied by the pressure member to the belt. The pressure member includes: an elastic member for applying pressures so that greater pressure is applied to center of the roller than to the ends, the center and the ends being along axis direction of the roller; and a hard member that is disposed parallel to the elastic member on downstream side thereof in a revolving direction of the belt and applies pressures to the roller so that greater pressure is applied to the ends than to the center.

18 Claims, 7 Drawing Sheets

FIG. 9

| | Amount of projection | | | | | |
|---|---|---|---|---|---|---|
| | 0 | 0.1 | 0.2 | 0.3 | 0.4 | 0.5 |
| Experiment 1 (Fig. 4) | × | △ | ○ | ○ | ○ | ○ |
| Experiment 2 (Fig. 6) | × | △ | △ | ○ | ○ | ○ |
| Experiment 3 (Fig. 7) | × | △ | ○ | ○ | ○ | ○ |
| Experiment 4 (Fig. 8) | × | △ | △ | ○ | ○ | ○ |

× : Wrinkle occurs △ : Wrinkle occurs infrequently
○ : No wrinkle occurs

FIXING DEVICE AND IMAGE FORMING DEVICE

This application is based on an application No. 2009-128540 filed in Japan, the contents of which are hereby incorporated by reference.

BACKGROUND OF THE INVENTION (1) Field of the Invention

The present invention relates to a fixing device for fixing an image formed on a recording sheet onto the recording sheet by applying heat and pressure to the recording sheet while the recording sheet passes through a fixing nip formed between a fixing roller and a pressure belt pressed against each other, and relates to an image forming device provided with the fixing device.

(2) Description of the Related Art

An image forming device such as a copier is provided with a fixing device for fixing a toner image formed on a recording sheet, such as a sheet of recording paper or an OHP sheet, onto the recording sheet. In the fixing device, a fixing nip is formed. The fixing device fixes the toner image onto the recording sheet by applying heat and pressure to the recording sheet while the recording sheet is passing through the fixing nip.

In the fixing device, when the recording sheet passes through the fixing nip, the nip pressure applied to the recording sheet may be distributed nonuniformly in the width direction of the recording sheet perpendicular to the recording sheet transport direction, and the transportation speed of the recording sheet may become slower at the ends thereof than at the center in the width direction of the recording sheet. In that case, when the recording sheet enters the fixing nip, stresses directed from the center toward the ends thereof in the width direction of the recording sheet are generated in the initial portion of the recording sheet that has entered the fixing nip. At the same time, in the portion of the recording sheet following the initial portion and having not yet entered the fixing nip, stresses directed from the ends toward the center thereof in the width direction of the recording sheet are generated. This may generate a wrinkle in the recording sheet when the portion of the recording sheet following the initial portion enters the fixing nip.

There have been proposed technologies addressing the above-described problem. For example, Literature 1 (Japanese Patent Application Publication No. H8-137310) discloses a fixing device in which a fixing nip is formed between a heating roller in rotation and a fixedly provided elastic member (made of an elastic material) pressed against the heating roller such that the surface of the elastic member pressed against the heating roller is closer to the heating roller at the center thereof than at the ends thereof, where the center and ends are along the width direction of the recording sheet. With this structure, the load applied to the elastic member becomes greater at the center thereof than at the ends thereof in the width direction of the recording sheet, and the friction resistance between the elastic member and the recording sheet becomes larger at the center. As a result of this, the transportation speed becomes slower at the center than at the ends, making it possible to prevent a wrinkle from being generated in the recording sheet.

Literature 2 (Japanese Patent Application Publication No. 2005-4126) discloses a fixing device which forms a fixing nip between a fixing roller and a pressure belt by causing a pressure pad, composed of an elastic pad and a hard pad, to press the back surface (inner circumferential surface) of the pressure belt so that the pressure belt is brought into contact with the fixing roller, where the center portion of the pressure surface of the elastic pad is shorter than each of the two end portions (the center and ends being along the axis direction of the fixing roller) in the transportation direction of the recording sheet (the circumferential direction).

With this structure, the fixing nip, which is formed with the pressure surface of the elastic pad, becomes longer at the ends thereof than at the center thereof in the transportation direction of the recording sheet, therefore the area of the fixing nip to which the nip pressure is applied becomes longer in the transportation direction at the ends than at the center, and the force to transport the recording sheet becomes greater at the ends of the fixing nip than at the center of the fixing nip, where the center and ends are along the axis direction of the fixing roller, or the width direction of the recording sheet. As a result of this, the transportation speed of the recording sheet becomes faster at the ends than at the center, making it possible to prevent a wrinkle from being generated in the recording sheet.

However, the structure disclosed in Literature 1 has a problem that the heating roller and the elastic member pressed against the heating roller both have a large thermal capacity, and thus a warm-up period increases. Moreover, to increase the friction resistance, the heating roller is pressed by the elastic member, which is provided fixedly, more strongly at the center thereof than at the ends thereof in the width direction of the recording sheet. For this reason, the center of the heating roller in the axis direction of the heating roller may be deformed to be dented depending on the material of the elastic member.

In the case of the above-described structure, when the amount of dent generated at the center of the heating roller becomes larger, the transportation speed of the recording sheet in the fixing nip may become faster at the center thereof (where the moving distance of the recording sheet is longer) than at the ends thereof, where the center and ends are along the axis direction of the heating roller. This results in that the increase in the transportation speed of the recording sheet due to the increase of the amount of dent is larger than the decrease in the transportation speed of the recording sheet due to the increase of the friction resistance. In that case, it is impossible to surely prevent a wrinkle from being generated in the recording sheet passing through the fixing nip.

The fixing device disclosed in Literature 2 uses a pressure belt having a small thermal capacity, making it possible to reduce the warm-up period and restrict the abrasion of the pressure belt. However, the pressure surface of the elastic pad is longer at the ends thereof than at the center thereof in the transportation direction of the recording sheet, where the center and ends are along the axis direction of the fixing roller. Accordingly, since the pressure area of the elastic pad is broader at the ends than at the center, the recording sheet passing through the fixing nip is heated for a longer time at the ends thereof than at the center thereof, where the center and ends are along the width direction of the recording sheet. This may result in that the heat is applied nonuniformly to the recording sheet in the width direction of the recording sheet, causing nonuniform luster or the like due to nonuniform heating, thereby degrading the image quality of the fixed image.

SUMMARY OF THE INVENTION

An object of the present invention is therefore to provide a fixing device and an image forming device that prevent heat from being applied nonuniformly to the recording sheet in the width direction thereof, preventing a wrinkle from being generated in the recording sheet. One aspect of the present invention for fulfilling the above-described object is a fixing device for fixing an image onto a recording sheet by applying heat and pressure to the recording sheet and the image thereon while the recording sheet is passing through a fixing nip, the fixing device comprising: a pressure belt movable in a revolving motion; a rotatable fixing roller; and a pressure member for pressing an inner circumferential surface of the pressure belt toward the fixing roller, the fixing nip being formed between the fixing roller and the pressure belt while an elastically deformable surface of the fixing roller in rotation is brought into contact with an outer surface of the pressure belt by a pressure applied by the pressure member to the inner circumferential surface of the pressure belt, the pressure member including: an elastic pressure member for applying pressures to the fixing roller to cause a pressure distribution in which a greater pressure is applied to a center of the fixing roller than to each of ends thereof, the center and the ends being along an axis direction of the fixing roller; and a hard pressure member that is disposed parallel to the elastic pressure member on downstream side of the elastic pressure member in a direction of the revolving motion of the pressure belt and applies pressures to the fixing roller to cause a pressure distribution in which a greater pressure is applied to each of the ends of the fixing roller than to the center of the fixing roller.

Another aspect of the present invention for fulfilling the above-described object is an image forming device comprising an imaging forming part for forming an image and transferring the image on a recording sheet and a fixing device for fixing an image onto a recording sheet by applying heat and pressure to the recording sheet and the image thereon while the recording sheet is passing through a fixing nip, the fixing device including: a pressure belt movable in a revolving motion; a rotatable fixing roller; and a pressure member for pressing an inner circumferential surface of the pressure belt toward the fixing roller, the fixing nip being formed between the fixing roller and the pressure belt while an elastically deformable surface of the fixing roller in rotation is brought into contact with an outer surface of the pressure belt by a pressure applied by the pressure member to the inner circumferential surface of the pressure belt, the pressure member including: an elastic pressure member for applying pressures to the fixing roller to cause a pressure distribution in which a greater pressure is applied to a center of the fixing roller than to each of ends thereof, the center and the ends being along an axis direction of the fixing roller; and a hard pressure member that is disposed parallel to the elastic pressure member on downstream side of the elastic pressure member in a direction of the revolving motion of the pressure belt and applies pressures to the fixing roller to cause a pressure distribution in which a greater pressure is applied to each of the ends of the fixing roller than to the center of the fixing roller.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings:

FIG. 9 shows the results of the experiments conducted on the fixing device in the embodiment of the present invention.

DESCRIPTION OF THE PREFERRED EMBODIMENTS

Figure 1:
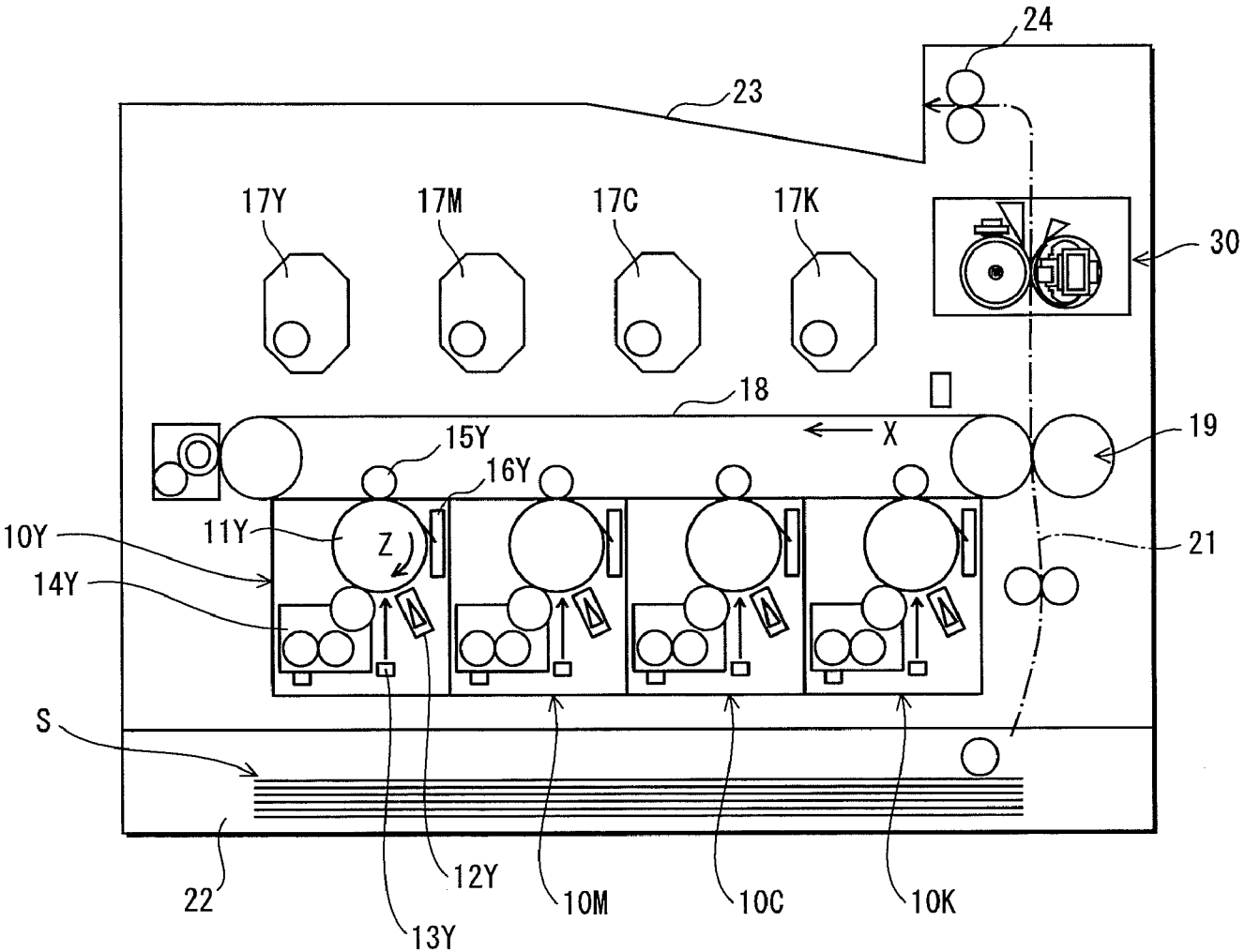
FIG. 1 is a schematic diagram showing the general structure of a color printer, which is an example of the image forming device provided with the fixing device described as an embodiment of the present invention.

The fixing device of the present embodiment is structured such that the pressure applied by an elastic pressure member to a fixing roller causes a pressure distribution in which a greater pressure is applied to a center of the fixing roller than to ends thereof, and the pressure applied by a hard pressure member to the fixing roller causes a pressure distribution in which a greater pressure is applied to the ends of the fixing roller than to the center thereof, the center and the ends being along an axis direction of the fixing roller. With this structure, the amount of deformation of the fixing roller caused by the pressure applied by the hard pressure member is greater at the ends than at the center, making the transportation speed of the recording sheet faster at the ends than at the center, thereby preventing a wrinkle from being generated in the recording sheet.

In the case of the above-described structure, the surface of the fixing roller is elastically deformed along the axis direction by the hard pressure member so that the transportation speed of the recording sheet in the fixing nip is faster at the ends thereof than at the center thereof. This results in that the size of the fixing nip generated by the pressure of the elastic pressure member does not change in the axis direction, thus preventing the fixing condition in the fixing nip from becoming nonuniform along the width direction of the recording sheet, preventing the image quality of the fixed image from degrading due to nonuniform heating or the like.

In the above-described fixing device, an urging force toward the fixing roller may be acted on the elastic pressure member and the hard pressure member, and by the urging force, the elastic pressure member may deform elastically when pressed against the fixing roller and the fixing roller deforms elastically when pressed by the hard pressure member so that the pressures applied by the elastic pressure member and the hard pressure member cause the respective pressure distributions.

In the above-described fixing device, the elastic pressure member may have a projection so that a center portion thereof is closer to the fixing roller than end portions thereof when the elastic pressure member is in a state of not pressing the fixing roller, wherein the center portion and the end portions are along the axis direction of the fixing roller, and the elastic pressure member deforms elastically following a shape of an outer circumferential surface of the fixing roller when the elastic pressure member is in a state of pressing the fixing roller.

In the above-described fixing device, the elastic pressure member may have a shape of projection in which the elastic pressure member rises step by step like a staircase from ends thereof toward a center thereof so that the center portion is closer to the end portions when the elastic pressure member is in the state of not pressing the fixing roller.

In the above-described fixing device, the elastic pressure member may have a pair of slant surfaces that face toward the fixing roller and rise by degrees from the ends toward the center so that the center portion is closer to the end portions when the elastic pressure member is in the state of not pressing the fixing roller.

In the above-described fixing device, the pressure member may further include a main pressure part that causes the urging force to act on both of the elastic pressure member and the hard pressure member.

In the above-described fixing device, the main pressure part and the hard pressure member may have been formed as one unit.

In the above-described fixing device, the main pressure part may have a supporting surface supporting the elastic pressure member, the supporting surface has a shape in which the supporting surface rises from ends thereof toward a center thereof to form a projection so that the center is closer to the fixing roller than the ends, the center and the ends being along the axis direction of the fixing roller, and the elastic pressure member is in a shape of plane-parallel plates and deforms following the shape of the supporting surface when the elastic pressure member is in the state of not pressing the fixing roller.

In the above-described fixing device, the main pressure part may have a flat supporting surface supporting the elastic pressure member, and the elastic pressure member may have a shape of projection so that a center portion thereof is closer to the fixing roller than end portions thereof when the elastic pressure member is in a state of not pressing the fixing roller, wherein the center portion and the end portions are along the axis direction of the fixing roller.

In the above-described fixing device, a difference in height between the center portion and the end portions of the elastic pressure member may be in a range from 0.1 mm to 0.6 mm inclusive.

FIG. 1 is a schematic diagram showing the general structure of a color printer, which is an example of the image forming device provided with the fixing device described as an embodiment of the present invention. This color printer forms a toner image by a known electrophotographic method based on image data or the like input from an external terminal device or the like via a network (for example, LAN), and then transfers the toner image onto a recording sheet S that is transported by a sheet transport route 21 from a paper-feed cassette 22 provided in the lower part of the color printer. The recording sheet S with the toner image transferred thereon is transported to a fixing device 30, and the fixing device 30 fixes the toner image onto the recording sheet S.

An intermediate transfer belt 18 is provided at an approximate center of the color printer in the vertical direction, where the circular motion area of the intermediate transfer belt 18 extends in the horizontal direction. The intermediate transfer belt 18 moves in the direction indicated by the arrow "X". Image forming parts 10Y, 10M, 10C, and 10K are provided below the intermediate transfer belt 18. The image forming parts 10Y, 10M, 10C, and 10K are disposed in the stated order in the direction in which the intermediate transfer belt 18 moves in a revolving motion.

Above the intermediate transfer belt 18, toner containers 17Y, 17M, 17C, and 17K are disposed to face the image forming parts 10Y, 10M, 10C, and 10K respectively via the intermediate transfer belt 18. The toner containers 17Y, 17M, 17C, and 17K respectively contain toners of colors yellow (Y), magenta (M), cyan (C), and black (K), which are supplied to the image forming parts 10Y, 10M, 10C, and 10K, respectively. The image forming parts 10Y, 10M, 10C, and 10K form toner images by the supplied toners of colors.

In the following, only the structure of the image forming part 10Y is explained, and description of the structures of the other image forming parts 10M, 10C, and 10K is omitted since they have substantially the same structure except that they use toners of different colors to form respective toner images.

The image forming part 10Y includes a photosensitive drum 11Y, a charger 12Y, a developing device 13Y, and a developing part 14Y. The photosensitive drum 11Y is disposed under the intermediate transfer belt 18 so that it can rotate in the direction indicated by the arrow "Z" while facing the intermediate transfer belt 18. The charger 12Y is disposed below the photosensitive drum 11Y to face it. The developing device 13Y and the developing part 14Y are disposed in the stated order in the downstream of the charger 12Y in the rotation direction of the photosensitive drum 11Y.

The surface of the photosensitive drum 11Y is charged evenly by the charger 12Y. A laser beam L is radiated from the developing device 13Y onto the surface of the photosensitive drum 11Y to form an electrostatic latent image thereon. The electrostatic latent image formed on the surface of the photosensitive drum 11Y is developed by the developing part 14Y with use of the toner of color Y supplied from the toner container 17Y.

The developing part 14Y is provided with a developing roller that holds the toner of the color Y on the outer circumference thereof. As the developing roller rotates upon receiving application of a developing bias voltage, the toner of the color Y on the developing roller is transported to a position facing the photosensitive drum 11Y, at which the toner of the color Y is attached to the electrostatic latent image having been formed on the surface of the photosensitive drum 11Y, thus forming the toner image of the color Y.

Above the photosensitive drum 11Y, a first transfer roller 15Y is disposed to face the photosensitive drum 11Y via the intermediate transfer belt 18. By the action of the electric field formed by the first transfer roller 15Y on which a transfer bias voltage has been applied, the toner image is transferred from the photosensitive drum 11Y onto the intermediate transfer belt 18 as the first transfer. After the transfer of the toner image, the photosensitive drum 11Y is cleaned by a cleaner 16Y.

Note that, when a full-color image is to be formed, the timings at which the image forming parts 10Y, 10M, 10C, and 10K form the respective images are adjusted so that, by the multi-transfer, the toner images are transferred from the photosensitive drums 11Y, 11M, 11C, and 11K to the same area on the surface of the intermediate transfer belt 18. When a monochrome image is to be formed, only a selected image forming part (for example, the image forming part 10K that uses the toner of color K) is driven so that a toner image is formed on the photosensitive drum 11K and transferred therefrom to a predetermined area on the surface of intermediate transfer belt 18.

A second transfer roller 19 is disposed at a location to face, via the sheet transport route 21, an end (shown on the right-hand side of FIG. 1) of the intermediate transfer belt 18' which is located in the downstream of the photosensitive drums in the direction in which the toner images having been transferred therefrom onto the intermediate transfer belt 18 are transported thereon. By the action of the electric field formed by the second transfer roller 19 on which a transfer bias voltage has been applied, the toner image is transferred onto the intermediate transfer belt 18 is transferred onto the recording sheet S, which is transported by the sheet transport route 21, as the second transfer.

The recording sheet S is passed through between the intermediate transfer belt 18 and the second transfer roller 19 to be transported to a fixing device 30 disposed above the second transfer roller 19. In the fixing device 30, the toner image on the recording sheet S is heated and pressed to be fixed onto the recording sheet S. The recording sheet S with the toner image fixed thereon is ejected by a paper-eject roller 24 onto a paper tray 23 disposed above the toner containers 17Y, 17M, 17C, and 17K.

Figure 2:
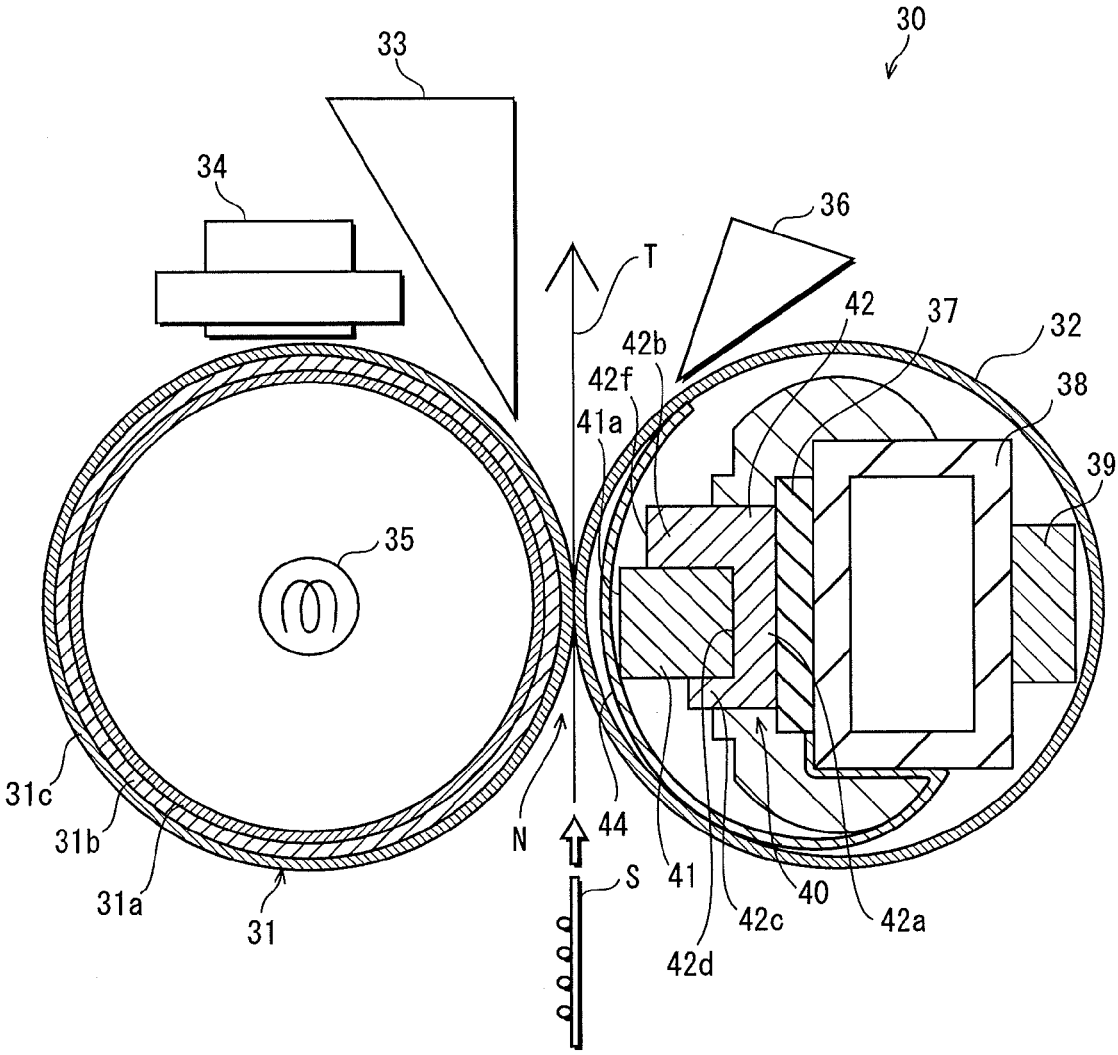
FIG. 2 is a schematic cross-sectional view showing the general structure of the main part of the fixing device.

FIG. 2 is a schematic cross-sectional view showing the general structure of the main part of the fixing device 30. The fixing device 30 includes: a fixing roller 31 that is driven to rotate; and a pressure belt 32 pressed by a pressure member 40 to be in contact with the fixing roller 31. While pressed onto the fixing roller 31, the pressure belt 32, an endless belt, moves in the revolving motion, passively following the rotation of the fixing roller 31. The fixing roller 31 and the pressure belt 32, while they are pressed against each other, form a fixing nip N through which the recording sheet S passes.

The fixing roller 31 has a cylindrical structure, and at the axial center thereof, a heater 35 is provided. The heater 35 heats the surface of the fixing roller 31 to a predetermined temperature at which the toner thereon melts. The heater 35 is controlled based on the surface temperature of the fixing roller 31 that is measured by a thermistor 34.

The recording sheet S with the unfixed toner image thereon is transported to the fixing device 30, and the toner image is fixed onto the recording sheet S when it passes through the fixing nip N while being heated and pressed. The recording sheet S with the toner image fixed thereon is separated from the fixing roller 31 by separators 33 and 36, and is transported to the paper-eject roller 24 (see FIG. 1).

Note that in the following description, "recording sheet transport direction plane T" refers to a virtual plane that is parallel to the axis of the fixing roller 31 and includes a tangential line of the fixing roller 31 at a position where the fixing roller 31 contacts the pressure belt 32 in the state where the pressure belt 32 is not pressing the fixing roller 31.

The fixing roller 31 has, for example, an outer diameter in the range of approximately 10 mm to 50 mm, and includes a core bar 31*a*, an intermediate layer 31*b*, and a surface layer 31*c*. The core bar 31*a* is composed of a metal pipe made of aluminum, iron or the like whose thickness is in the range of approximately 0.1 mm to 5.0 mm. The intermediate layer 31*b* is formed on the outer circumferential surface of the core bar 31*a*. The surface layer 31*c* covers the surface of the intermediate layer 31*b*.

It is preferable that the core bar 31*a* has, for example, a thickness in the range of approximately 0.2 mm to 1.5 mm when the reduction in weight and warm-up time is taken into account, where the warm-up time is a time required for the surface temperature of the fixing roller 31 upon power-on to reach a temperature necessary for the fixing.

The intermediate layer 31*b* that is inserted between the core bar, 31*a* and the surface layer 31*c* of the fixing roller 31 is composed of an elastic member that elastically deforms when the pressure belt 32 is pressed by the pressure member 40. The intermediate layer 31*b* is preferably made of a heat-resistant material, and thus is made of silicon rubber, fluorine-containing rubber or the like. The intermediate layer 31*b* may have an arbitrary thickness, but preferably has a thickness in the range of approximately 0.05 mm to 2 mm.

The surface layer 31*c* covering the surface of the intermediate layer 31*b* is preferably composed of a fluorine-base coating, a fluorine-base tube such as PFA, PTFE, or ETEE or the like so that it has the releasability from the recording sheet S. As the fluorine-base tube, for example, any of "PFA350-J", "451HP-J" and "951HP Plus", products made by Du Pont-Mitsui Fluorochemicals, may be used. The surface layer 31*c* may be electrically conductive. The surface layer 31*c* preferably has a thickness in the range of approximately 5 μm to 100 μm. Also, the surface layer 31*c* preferably has a contact angle of 90 degrees or more, and more preferably has a contact angle of 110 degrees or more. A surface roughness Ra of the surface layer 31*c* is preferably in the range of approximately 0.01 μm to 50 μm.

The pressure belt 32 includes a base member which is formed by making a belt-like member into an endless shape. The belt-like member is made of polyimide, polyphenylene-sulfide, nickel, iron, SUS or the like. The surface of the base member may be covered with a surface layer that is composed of a fluorine-base coating, a fluorine-base tube such as PFA, PTFE, or ETEE or the like so that it has the releasability from the recording sheet S. The surface layer may be electrically conductive. The surface layer preferably has a thickness in the range of approximately 5 μm to 100 μm. The pressure belt 32 may have an arbitrary thickness, but preferably has a thickness in the range of approximately 0.05 mm to 2 mm. The outer diameter of the pressure belt 32 is preferably in the range of approximately 20 mm to 100 mm. To prevent the pressure belt 32 from meandering during the revolving motion, each side edge of the pressure belt 32 in the width direction thereof is guided by a belt guide member (not illustrated).

The pressure member 40 is provided inside the path of the revolving motion of the pressure belt 32 such that it faces the fixing roller 31, extending along the axis of the fixing roller 31. The pressure member 40 presses the inner circumferential surface of the pressure belt 32 via a low-friction sheet 44. More specifically, the pressure member 40 presses the inner circumferential surface of the pressure belt 32 over the entire width thereof via the low-friction sheet 44 so that the outer circumferential surface of the pressure belt 32 is brought into contact with the outer circumferential surface of the fixing roller 31 over the entire width thereof by the pressure. This forms the fixing nip N along the axis of the fixing roller 31.

FIG. 2 shows, for the sake of understanding, the state in which the low-friction sheet 44 is in contact neither with the inner circumferential surface of the pressure belt 32 nor the pressure member 40, thus the pressure belt 32 is not pressed to the fixing roller 31 by the pressure member 40. Note, however, that, when the fixing device 30, built-up with these members, performs the fixing, the pressure member 40 presses the pressure belt 32 via the low-friction sheet 44 so that the pressure belt 32 is brought into contact with the fixing roller 31 by the pressure (see FIGS. 5A and 5B).

The pressure member 40 is supported by a supporting frame 38 via an elastic sheet 37, the supporting frame 38 being provided inside the path of the revolving motion of the pressure belt 32. The supporting frame 38 has been made by forming a metal such as aluminum or iron into a tube whose cross section is rectangular, by the drawing, extrusion, plating or the like. The supporting frame 38 is arranged such that the length thereof extends along the direction of the width of the pressure belt 32.

The supporting frame 38 is longer than the width of the pressure belt 32, and the two ends of the supporting frame 38 in the length direction thereof extends more outward than the two respective side edges of the pressure belt 32 in the width direction thereof. The two end portions of the supporting frame 38 are urged toward the fixing roller 31 by the urging means such as springs. The supporting frame 38 is arranged so that one surface (front surface) thereof faces the fixing roller 31. The pressure member 40 is supported on the front surface of the supporting frame 38 via the elastic sheet 37.

An oil application member 39 for applying a lubricant oil onto the inner circumferential surface of the pressure belt 32 is provided on a surface (back surface) of the supporting frame 38 that is opposite to the surface thereof on which the elastic sheet 37 is provided. The oil application member 39 is composed of, for example, a felt filled with a lubricant oil. The lubricant oil is applied over the entire inner circumferential surface of the pressure belt 32 when the pressure belt 32 moves in the revolving motion while the oil application member 39 is in sliding contact with the inner circumferential surface of the pressure belt 32.

The pressure member 40 includes a hard pressure member 42 and an elastic pressure member 41. The hard pressure member 42 is provided on the elastic sheet 37 which is provided on the front surface of the supporting frame 38. The elastic pressure member 41 is held by the hard pressure member 42 to face the outer circumferential surface of the fixing roller 31 via the low-friction sheet 44 and the pressure belt 32. The elastic pressure member 41 is made of an elastic material. The hard pressure member 42 is made of a material that is harder than the elastic pressure member 41.

The hard pressure member 42 includes a main pressure part 42*a*, a hard pressure part 42*b*, and a side wall part 42*c*. The main pressure part 42*a* extends straightly along the width direction of the pressure belt 32. The hard pressure part 42*b* is provided along a side-edge portion of the main pressure part 42*a* that is located on the downstream side in the recording sheet transfer direction. The side wall part 42*c* is provided along a side-edge portion of the main pressure part 42*a* that is located on the upstream side in the recording sheet transfer direction. The hard pressure part 42*b* and the side wall part 42*c* project toward the fixing roller 31 by respective predetermined lengths. Note that the amount of projection of the side wall part 42*c* from the main pressure part 42*a* is smaller than the amount of projection of the hard pressure part 42*b* from the main pressure part 42*a*.

A surface (back surface) of the main pressure part 42*a* on the side of the supporting frame 38 is flat so that the urging force (pressure) applied to the supporting frame 38 is transmitted evenly over the entire area in the width direction thereof. The back surface of the main pressure part 42*a* is supported on the elastic sheet 37. A surface of the main pressure part 42*a* between the hard pressure part 42*b* and the side wall part 42*c* is a supporting surface 42*d* for supporting the elastic pressure member 41 so that a pressure is applied to the elastic pressure member 41 from the back surface side thereof.

The elastic pressure member 41 is in the shape of a rectangular solid (plane-parallel plates) whose cross section is rectangular, extending along the width direction of the pressure belt 32 to the full width thereof, when it is not pressing the pressure belt 32 via the low-friction sheet 44. The elastic pressure member 41 is structured such that the length (thickness) thereof in the direction perpendicular to the recording sheet transport direction plane T is constant along the width direction of the pressure belt 32. The elastic pressure member 41 is held by the hard pressure member 42 in the state where it is sandwiched by the hard pressure part 42*b* and the side wall part 42*c* and a surface (back surface) of the elastic pressure member 41 facing the supporting surface 42*d* of the main pressure part 42*a* is in contact with the supporting surface 42*d*.

A surface (front surface) of the elastic pressure member 41 that is opposite to the surface thereof being in contact with the supporting surface 42*d* is an elastic pressure surface 41*a* that presses the fixing roller 31 via the low-friction sheet 44 and the pressure belt 32. A length (in FIG. 2, the width being a length in the vertical direction of paper) of the elastic pressure surface 41*a* is substantially constant along the recording sheet transport direction plane T in its entirety.

Figure 3:
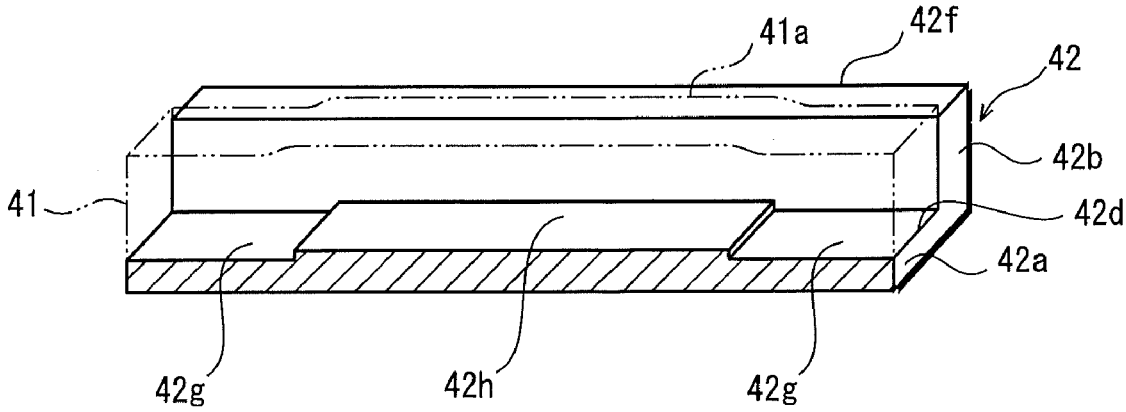
FIG. 3 is a cut-away perspective view of the hard pressure member of the pressure member provided in the fixing device.

FIG. 3 is a perspective view of the hard pressure member 42. Note that in FIG. 3, the top surface of the hard pressure member 42 faces the fixing roller 31 in the vertical direction of paper, and that the cross section of the main pressure part 42*a* is shown in the state where the side wall part 42*c* is removed. The supporting surface 42*d* of the main pressure part 42*a* is composed of end flat surfaces 42*g* and a center flat surface 42*h*. The end flat surfaces 42*g* are located at two respective ends of the supporting surface 42*d* in the width direction of the pressure belt 32. The center flat surface 42*h* is located at the center of the supporting surface 42*d*.

Each of the end flat surfaces 42*g* and the center flat surface 42*h* is a flat plane parallel to the recording sheet transport direction plane T, but the center flat surface 42*h* is closer to the fixing roller 31 than the end flat surfaces 42*g*. Accordingly, the center flat surface 42*h* projects out toward the fixing roller 31 from the end flat surfaces 42*g*, and there is a difference in height between the end flat surfaces 42*g* and the center flat surface 42*h*, forming steps.

The elastic pressure member 41 is placed to cover the supporting surface 42*d* to its entirety, and deforms following the shape of the supporting surface 42*d*, so that the elastic pressure surface 41*a* has substantially the same shape as the supporting surface 42*d* to its entirety. That is to say, in the state where the elastic pressure member 41 has been translated and is not pressing the fixing roller 31, flat surfaces that are parallel to the end flat surfaces 42*g* are formed at respective ends of the elastic pressure surface 41*a* in the width direction of the pressure belt 32, and a flat surface that is parallel to the center flat surface 42*h* is formed at the center of the elastic pressure surface 41*a* in the width direction of the pressure belt 32. Accordingly, in the state where the elastic pressure member 41 has been translated and is not pressing the fixing roller 31, the elastic pressure surface 41*a*, in similar to the supporting surface 42*d* of the main pressure part 42*a*, is closer to the fixing roller 31 at the center thereof than at the ends thereof, where the center and ends are along the axis direction of the fixing roller 31.

In the state where the pressure belt 32 is in contact with the fixing roller 31 by the pressure, the pressure that is applied to the main pressure part 42*a* by the supporting frame 38 is applied to the elastic pressure member 41 from the back thereof. With this pressure, the elastic pressure surface 41*a* presses the inner circumferential surface of the pressure belt 32 over the entire width thereof via the low-friction sheet 44, thus the pressure belt 32 is brought into contact with the surface of the fixing roller 31 by the pressure.

In such a state, the elastic pressure member 41 is elastically deformed by the reaction force of the fixing roller 31, so that the surface of the elastic pressure surface 41*a* is deformed following the shape of the surface of the fixing roller 31. The fixing roller 31 and the pressure belt 32 in this state form therebetween a first nip portion in which the unfixed toner image on the recording sheet S passing therethrough is fixed onto the recording sheet S by the heating and pressure it receives. In this case, in terms of the distribution of the pressure, the pressure applied by the elastic pressure member 41 to the center of the surface of the fixing roller 31 in the axis direction thereof is larger than the pressure applied to each end of the surface of the fixing roller 31 in the axis direction.

The hard pressure part 42*b* arranged adjacently in the downstream of the elastic pressure member 41 in the revolving direction of the pressure belt 32 is formed as one unit with the main pressure part 42*a*, from the same hard material. In the state where the pressure belt 32 is in contact with the fixing roller 31 by the pressure, the urging force that is applied to the main pressure part 42*a* by the supporting frame 38 is applied to the hard pressure part 42*b* from the back thereof. With this pressure, the hard pressure part 42*b* presses the surface of the fixing roller 31 via the low-friction sheet 44 and the pressure belt 32. Accordingly, the front-end surface of the hard pressure part 42*b* on the fixing roller 31 side is a hard pressure surface 42*f* that presses the fixing roller 31. Tne length of the hard pressure surface 42*f* along the recording sheet transport direction plane T is constant over the entire hard pressure surface 42*f*.

When the hard pressure surface 42*f*, the front-end surface of the hard pressure part 42*b*, presses the inner circumferential surface of the pressure belt 32 over the entire width thereof via the low-friction sheet 44, and the pressure belt 32 is brought into contact with the surface of the fixing roller 31 by the pressure, the surface of the fixing roller 31 is elastically deformed to be in the state of being dented. In such a state, the fixing roller 31 and the pressure belt 32, which has been deformed following the deformed shape of the outer circumferential surface of the fixing roller 31, form therebetween a second nip portion.

The second nip portion has a larger nip pressure than the first nip portion formed by the elastic pressure member 41. Thus, in the second nip portion, the surface of the fixing roller 31 is elastically deformed to have a dent with an arc having smaller radius of curvature than the dent formed in the first nip portion. The recording sheet S is released from the fixing roller 31 since it cannot move following the deformed portion having the smaller radius of curvature of the fixing roller 31. In this way, by such "curvature release", the recording sheet S is easily released from the surface of the fixing roller 31.

The first nip portion, which is formed by the pressing by the elastic pressure surface 41*a* of the elastic pressure member 41, is formed to be longer along the recording sheet transport direction than the second nip portion which is formed by the pressing by the hard pressure surface 42*f* of the hard pressure part 42*b*. The unfixed toner image is fixed onto the recording sheet S in the first nip portion. In this way, since the first nip portion for fixing the unfixed toner image is long, the toner image can be fixed in a reliable manner.

The main pressure part 42*a*, hard pressure part 42*b*, and side wall part 42*c* are formed as one unit as the hard pressure member 42 from the same material which may be, for example, a resin such as polyphenylenesulfide, polyimide, or liquid-crystal polymer, a metal such as aluminum or iron, or ceramic. Accordingly, the main pressure part 42*a*, hard pressure part 42*b*, and side wall part 42*c* constitute one hard member as a whole. The pressure applied to the main pressure part 42*a* is transmitted to the hard pressure part 42*b* in the same pressure distribution state as the pressure distribution state in the length direction (direction along the axis direction of the fixing roller 31).

Note that any one of or every one of the main pressure part 42*a*, hard pressure part 42*b*, and side wall part 42*c* may be formed from a hard material that is different from the materials of the others, and then the main pressure part 42*a*, hard pressure part 42*b*, and side wall part 42*c* having been formed in this way may be combined as one unit to be the hard pressure member 42. In that case also, the main pressure part 42*a*, hard pressure part 42*b*, and side wall part 42*c* constitute one hard member as a whole, and the distribution state of the pressure applied to the hard pressure part 42*b* becomes the same as the distribution state of the pressure applied to the main pressure part 42*a*.

The elastic pressure member 41 is made of a highly heat-resistant, elastic material such as silicon-base rubber or fluorine-base rubber. The hardness of the elastic pressure member 41 is preferably in the range of 15 to 30 degrees on the Asker C-Scale. The thickness (the length in the direction perpendicular to the recording sheet transport direction plane T) of the elastic pressure member 41 is in the range of approximately 2.0 mm to 10 mm.

The low-friction sheet 44, which mediates between (i) the inner circumferential surface of the pressure belt 32 and (ii) the elastic pressure member 41 and the hard pressure part 42*b* of the hard pressure member 42 in the pressure member 40, is provided to decrease the resistance that is to be generated when the pressure belt 32 and the pressure member 40 slide with each other. The low-friction sheet 44 is, for example, structured from a glass cloth as a base material which is filled with a heat-resistant resin. As the heat-resistant resin, a fluorine-base resin such as PTFE is used.

The low-friction sheet 44 is a rectangular sheet that has been arranged so that one side edge thereof is in parallel to the width direction of the pressure belt 32 and another side edge perpendicular to the side edge follows the circumferential direction of the pressure belt 32. The length of the low-friction sheet 44 along the width direction of the pressure belt 32 is substantially the same as the length of the pressure belt 32 in the width direction thereof. The low-friction sheet 44 passes through between (i) the inner circumferential surface of the pressure belt 32 and (ii) the elastic pressure member 41 and the hard pressure part 42*b* of the hard pressure member 42, and the low-friction sheet 44 extends further towards downstream in the revolving direction of the pressure belt 32 than the hard pressure part 42*b* of the hard pressure member 42.

A portion of the low-friction sheet 44, which is located, in the revolving direction of the pressure belt 32, in the upstream of a portion sandwiched between the inner circumferential surface of the pressure belt 32 and the pressure member 40, is curved along the inner circumferential surface of the pressure belt 32. An end of the low-friction sheet 44 which is on the upstream side in the revolving direction of the pressure belt 32 is fixed onto a side surface of the supporting frame 38 which is located in the upstream of the front surface thereof in the recording sheet transfer direction. When the low-friction sheet 44 is pressed by the pressure member 40 onto the pressure belt 32 to contact therewith while its end on the upstream side in the revolving direction of the pressure belt 32 is fixed, and the pressure belt 32 moves in the revolving motion, the low-friction sheet 44 slides along the moving pressure belt 32.

In the fixing device 30 with the above-described structure, when the fixing roller 31 is driven to rotate while the pressure belt 32 is pressed by the pressure member 40 to be in contact with the fixing roller 31, the pressure belt 32 moves in the revolving motion passively following the rotation of the fixing roller 31. The recording sheet S with the toner image transferred thereon is transported and enters the fixing nip N formed between the fixing roller 31 and the pressure belt 32 in the above-stated state such that the fixing roller 31 faces a recording sheet surface on which the toner image has been transferred.

The fixing nip N is composed of: the first nip portion in which the pressure belt 32 is pressed by the elastic pressure member 41 to be in contact with the fixing roller 31; and the second nip portion in which the pressure belt 32 is pressed by the hard pressure part 42*b* of the hard pressure member 42 to be in contact with the fixing roller 31. With this structure, the toner image is fixed onto the recording sheet S in the first nip portion, and the recording sheet S is released from the surface of the fixing roller 31 by a "curvature release", and then the recording sheet S is ejected.

A lubricant oil is applied onto the inner circumferential surface of the pressure belt 32 by the oil application member 39, and the lubricant oil enters between the low-friction sheet 44 and the inner circumferential surface of the pressure belt 32. The surface of the low-friction sheet 44 is an uneven surface of the glass cloth being the base material, the uneven surface having bumps and dents. With this structure, the applied lubricant oil is retained in the dents in the surface of the low-friction sheet 44, not pushed out from between the low-friction sheet 44 and the inner circumferential surface of the pressure belt 32, even in the state where the low-friction sheet 44 is in contact with the inner circumferential surface of the pressure belt 32 by the pressure. The retained lubricant oil reduces the frictional resistance between the low-friction sheet 44 and the inner circumferential surface of the pressure belt 32. With this arrangement, the pressure belt 32 moves smoothly in the revolving motion.

The main pressure part 42*a* of the hard pressure member 42 in the pressure member 40 receives a predetermined urging force from the supporting frame 38 which is urged toward the fixing roller 31 so that the pressure belt 32 is brought into contact with the fixing roller 31, where the predetermined urging force is applied substantially evenly in the axis direction of the fixing roller 31. The main pressure part 42*a* causes the hard pressure part 42*b*, which is formed as one unit with the main pressure part 42*a*, and the elastic pressure member 41, which is supported by the supporting surface 42*d* of the main pressure part 42*a*, to act the urging force toward the fixing roller 31 onto the back surface side thereof.

Figure 4:
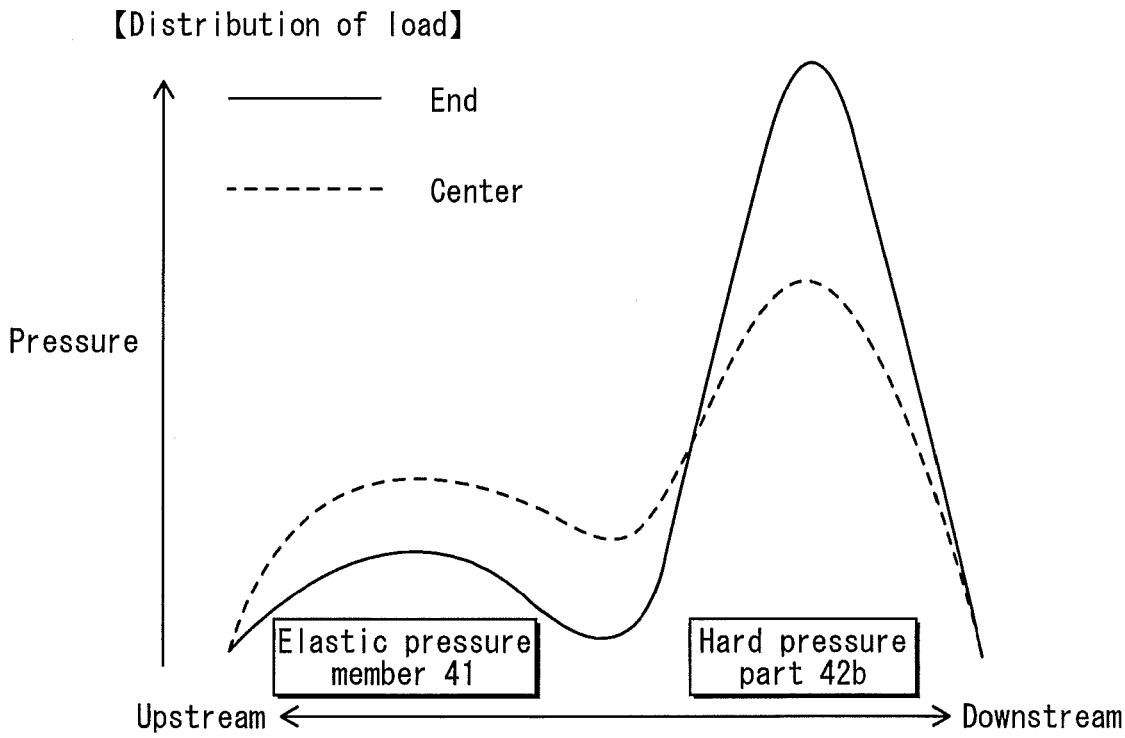
FIG. 4 is a graph showing distribution of the load (pressure distribution) applied to the fixing roller by the pressure member.

The elastic pressure surface 41*a*, the center portion of the elastic pressure member 41 of the pressure member 40, is closer to the fixing roller 31 than the end portions (the center and ends being along the axis direction of the fixing roller 31) when the pressure member 40 has been translated to separate from the fixing roller 31 and not in the pressing state. In the state where the pressure belt 32 is pressed onto the fixing roller 31, the elastic pressure surface 41*a*, by the pressure applied thereto, presses, via the low-friction sheet 44 and the pressure belt 32, the fixing roller 31 to elastically deform in the shape of a groove that extends in the axis direction of the fixing roller 31. With regard to the pressure distribution when the pressure is applied as described above, as shown in FIG. 4, the pressure (load) that is applied onto the fixing roller 31 by the elastic pressure member 41 is greater at the center (indicated by the dotted line in FIG. 4) than at the ends (indicated by the solid line in FIG. 4), where the center and ends are along the axis direction of the fixing roller 31.

When a pressure is applied to the fixing roller 31 by the elastic pressure member 41, a reaction force equivalent to the pressure is applied to the elastic pressure member 41 by the fixing roller 31. The reaction force is applied to the main pressure part 42*a* via the elastic pressure member 41. Accordingly, with regard to the pressure distribution, the reaction force that is applied onto the main pressure part 42*a* by the fixing roller 31 is greater at the center than at the ends.

The hard pressure part 42*b*, which is formed as one unit with the main pressure part 42*a*, receives a pressure that is applied to the elastic pressure member 41 toward the fixing roller 31 from the back-surface side thereof. The hard pressure part 42*b* also receives a reaction force (reverse pressure) that is applied to the main pressure part 42*a* by the fixing roller 31 toward the elastic pressure member 41 (in the reverse direction of the pressure). With this structure, the pressure acted on the fixing roller 31 by the hard pressure part 42*b* is reduced by the reverse pressure applied to the main pressure part 42*a*.

Accordingly, the pressure acted on the fixing roller 31 by the hard pressure part 42*b* and the pressure acted on the fixing roller 31 by the elastic pressure member 41 are acted in directions reverse to each other in the pressure distribution along the axis direction of the fixing roller 31. Thus in the pressure distribution, the pressure that is applied onto the fixing roller 31 by the hard pressure part 42*b* is greater at the ends than at the center, where the center and ends are along the axis direction of the fixing roller 31.

Figure 5B:
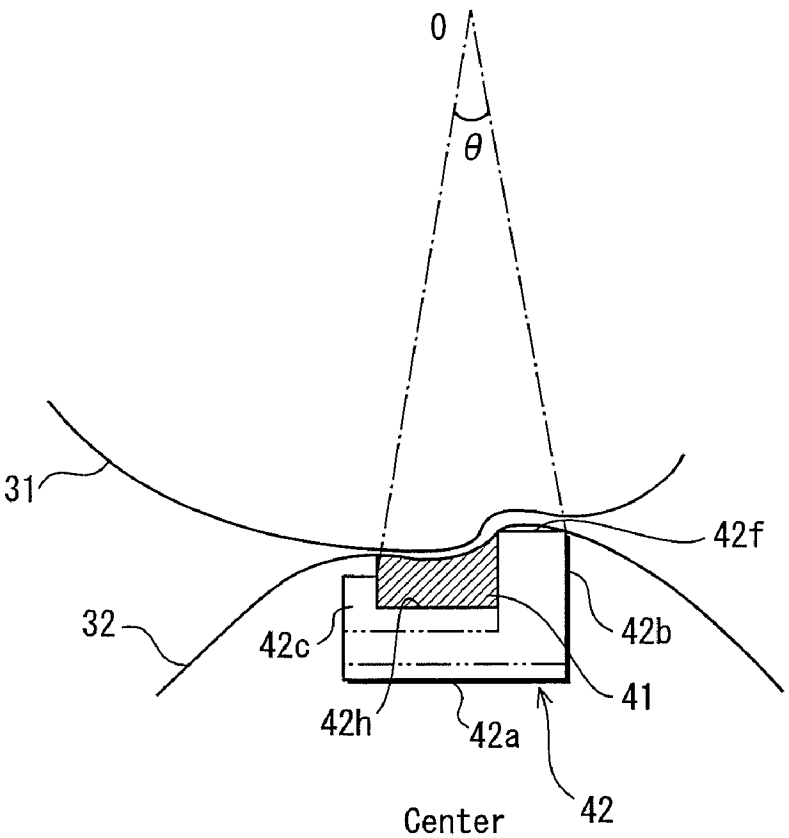
FIG. 5B is a schematic diagram for explaining the state in which the center (in the axis direction of the fixing roller) is pressed by the pressure member.
Figure 5A:
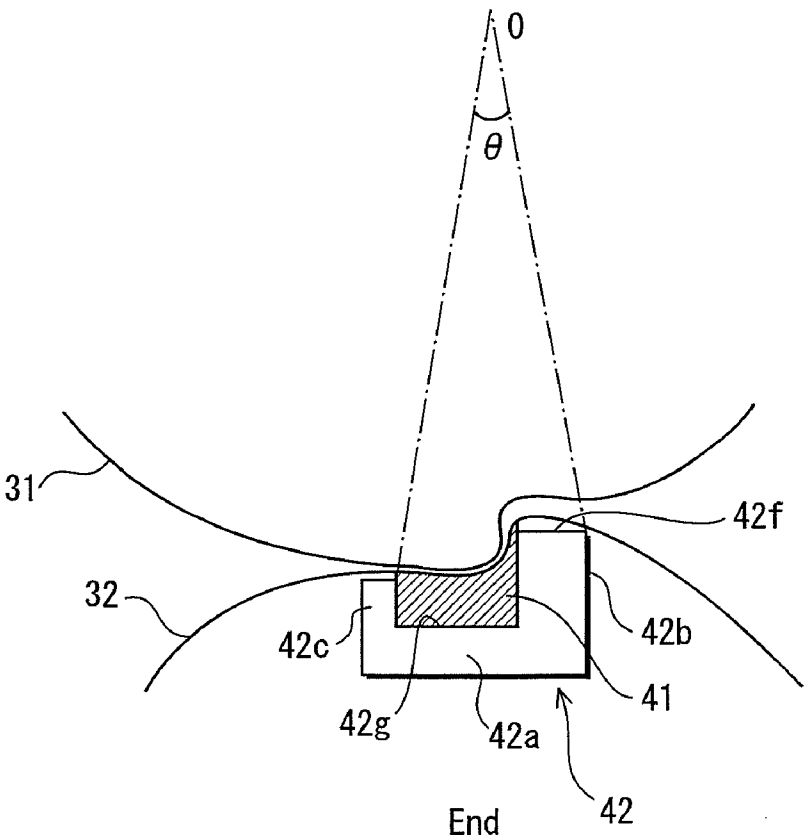
FIG. 5A is a schematic diagram for explaining the state in which the ends (in the axis direction of the fixing roller) are pressed by the pressure member.

FIG. 5A is a schematic diagram for explaining the state in which the ends (in the axis direction of the fixing roller) are pressed by the pressure member. FIG. 5B is a schematic diagram for explaining the state in which the center (in the axis direction of the fixing roller) is pressed by the pressure member. Note that in FIGS. 5A and 5B, to facilitate the understanding of the amount of elastic deformation in the fixing roller 31, the fixing roller 31 and the pressure belt 32 are separated from each other, and the low-friction sheet 44 is omitted. Also, the amount of elastic deformation and the like are emphasized for schematic representation.

When pressed by the hard pressure part 42*b*, the surface of the fixing roller 31 elastically deforms. In this case, the end (in the axis direction of the fixing roller 31) portions of the surface of the fixing roller 31 receive great pressures from the hard pressure part 42*b* and deform to have deep dents, as shown in FIG. 5A. On the other hand, the center (in the axis direction of the fixing roller 31) portion of the surface of the fixing roller 31 receive a smaller pressure from the hard pressure part 42*b* and deforms to have a shallower dent than the end portions, as shown in FIG. 5B.

The fixing nip N through which the recording sheet S passes is formed in the range in which the surface of the fixing roller 31 is pressed by the pressure member 40. Accordingly, the fixing nip N is formed in the range of center angle θ that is the same both in the end portions and the center portion of the fixing roller 31 in the axis direction thereof. As a result, the circumferential velocity at the portion of the surface of the fixing roller 31 on which the fixing nip N is formed is equivalent both in the end portions and the center portion of the fixing roller 31 in the axis direction thereof.

On the other hand, the actual length (path length) by which the recording sheet S is transported in the fixing nip N is a length along the deformed surface of the fixing roller 31. Thus the path length at the end portions, at which the fixing roller 31 deforms by a greater amount than at the center portion, is greater than the path length at the center portion. Therefore the transportation speed of the recording sheet S moving along the path length in the fixing nip N is faster at the end portions than at the center portion.

Accordingly, when the recording sheet S enters the fixing nip N, in the portion of the recording sheet S that has entered the fixing nip N (the front portion on the downstream side in the sheet transport direction), stresses directed from the both end portions toward the center portion in the width direction are generated and the center portion in the width direction is deflected. On the other hand, in the portion of the recording sheet S following the front portion and having not yet entered the fixing nip N, each end portion is pulled toward the outside by a pulling stress that is generated by the stresses generated in the front portion. This prevents a wrinkle from being generated when the portion of the recording sheet S following the front portion enters the fixing nip N.

Following this portion, the remaining portions of the recording sheet S pass through the fixing nip N in sequence without generating a wrinkle. Therefore no wrinkle is generated in the recording sheet S when it passes through the fixing nip N.

Here, the difference in height between the end flat surfaces 42*g* and the center flat surface 42*h* that are formed on the supporting surface 42*d* of the main pressure part 42*a* in the hard pressure member 42, namely, the projection length of the elastic pressure surface 41*a* in the state where the elastic pressure member 41 has been translated to separate from the fixing roller 31, is in the range from 0.1 mm to 0.6 mm, for example. Also, the length of the center flat surface 42*h* along the axis direction of the fixing roller 31 is in the range approximately from ⅓ to ½ the entire length of the supporting surface 42*d* in the axis direction of the fixing roller 31, for example.

When the projection length of the elastic pressure surface 41*a* toward the fixing roller 31 is smaller than 0.1 mm, the difference between the end portions and the center portion in the axis direction of the fixing roller 31 in the transportation speed of the recording sheet S moving along the path length in the fixing nip N is not great enough, and it may not be possible to effectively prevent a wrinkle from being generated in the recording sheet S. On the other hand, when the projection length of the elastic pressure surface 41*a* toward the fixing roller 31 is greater than 0.6 mm, the amount of deformation at the center portion in the axis direction of the fixing roller 31 becomes small, and the releasability from the recording sheet S is decreased.

To effectively prevent a wrinkle from being generated in the recording sheet S, it is preferable that the difference in height between the end flat surfaces 42*g* and the center flat surface 42*h* that are formed on the supporting surface 42*d* is in the range from 0.3 mm to 0.5 mm.

Similarly, when the length (along the axis direction of the fixing roller 31) of the center portion of the elastic pressure surface 41*a* projecting toward the fixing roller 31 is smaller than ⅓ the entire length (along the axis direction of the fixing roller 31) of the elastic pressure surface 41*a*, the difference between the end portions and the center portion in the axis direction of the fixing roller 31 in the transportation speed of the recording sheet S moving along the path length in the fixing nip N is not great enough; and when the length of the center portion is greater than ½ the entire length, the amount of deformation at the center portion in the axis direction of the fixing roller 31 becomes small, and the releasability from the recording sheet S is decreased.

Note that the structure for making the elastic pressure surface 41*a*, the center portion of the elastic pressure member 41 in the pressure member 40, closer to the fixing roller 31 than the end portions (the center and ends being along the axis direction of the fixing roller 31) in the state where the pressure member 40 has been translated to separate from the fixing roller 31 and not in the pressing state, is not limited to the above-described structure.

Figure 6:
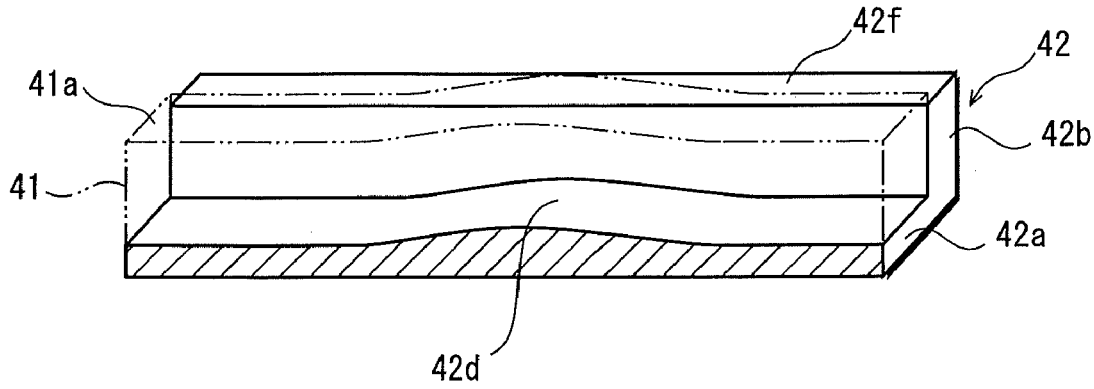
FIG. 6 is a cut-away perspective view of another example of the hard pressure member of the pressure member for use in the fixing device in the embodiment of the present invention.

For example, the structure shown in FIG. 6 may be adopted. More specifically, the supporting surface 42*d* of the main pressure part 42*a* on which the elastic pressure member 41 is supported may have a pair of slant surfaces that rise by degrees from the ends toward the center thereof so that the supporting surface 42*d* is closer to the fixing roller 31 at the center thereof than at the ends thereof such that the center portion projects toward the fixing roller 31 in the shape of arc, where the center and ends are along the axis direction of the fixing roller 31.

With the above-described structure, in the state where the elastic pressure member 41 has been translated to separate from the fixing roller 31, the elastic pressure member 41, which is supported by the supporting surface 42*d*, deforms following the shape of the supporting surface 42*d* of the main pressure part 42*a*, so that the elastic pressure surface 41*a* has substantially the same shape as the supporting surface 42*d* to its entirety. Thus the elastic pressure surface 41*a* of the elastic pressure member 41 supported by the supporting surface 42*d*, like the supporting surface 42*d*, rises by degrees from the ends toward the center thereof such that it is closer to the fixing roller 31 at the center thereof than at the ends thereof, projecting toward the fixing roller 31 in the shape of arc, where the center and ends are along the axis direction of the fixing roller 31.

With the above-described structure of the hard pressure member 42 as well, in the state where the pressure belt 32 is in contact with the fixing roller 31 by the pressure, the pressure applied to the fixing roller 31 by the elastic pressure member 41 is greater at the center than at the ends, and the pressure applied to the fixing roller 31 by the hard pressure part 42*b* is greater at the ends than at the center, where the center and ends are along the axis direction of the fixing roller 31. Thus the transportation speed of the recording sheet S moving along the path length in the fixing nip N is faster at the ends than at the center, where the center and ends are along the axis direction of the fixing roller 31.

Figure 7:
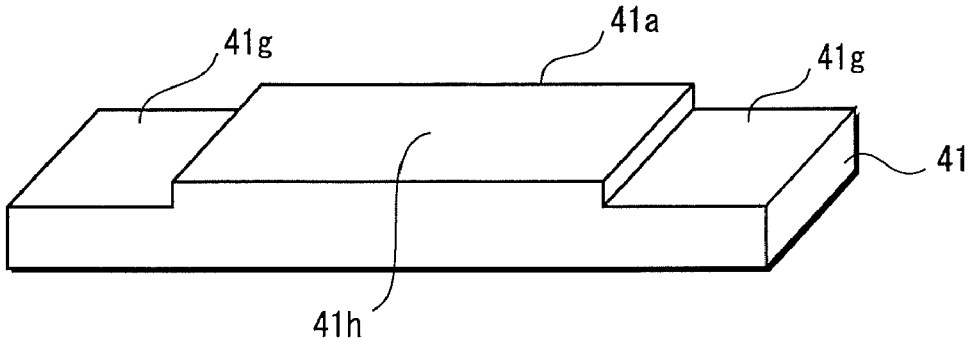
FIG. 7 is a perspective view showing another example of the elastic pressure member of the pressure member for use in the fixing device in the embodiment of the present invention.
Figure 8:
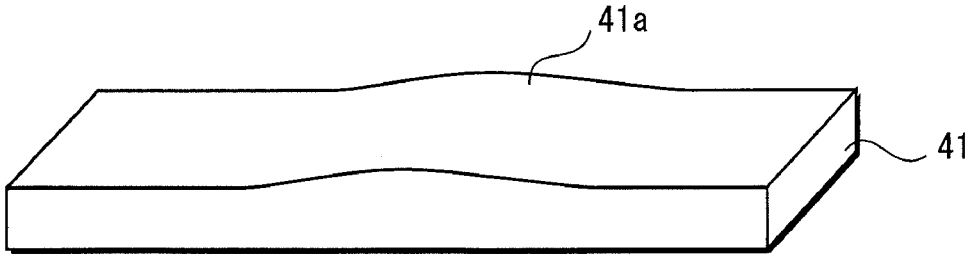
FIG. 8 is a perspective view showing a further example of the elastic pressure member of the pressure member for use in the fixing device in the embodiment of the present invention.

As another example of modification, the supporting surface 42*d* of the main pressure part 42*a* in the hard pressure member 42 may be formed as a flat plane parallel to the recording sheet transport direction plane T, and then as shown in FIGS. 7 and 8, the elastic pressure member 41 may be formed to be closer to the fixing roller 31 at the center thereof than at the ends thereof in the state where the elastic pressure surface 41*a* of the elastic pressure member 41 has been translated to separate from the fixing roller 31, where the center and ends are along the axis direction of the fixing roller 31.

In the elastic pressure member 41 shown in FIG. 7, the elastic pressure surface 41*a* is composed of end flat surfaces 41*g* and a center flat surface 41*h*. The end flat surfaces 41*g* are located at two respective ends of the elastic pressure surface 41*a* in the width direction of the pressure belt 32. The center flat surface 41*h* is located at the center of the elastic pressure surface 41*a* in the width direction of the pressure belt 32. Each of the end flat surfaces 41*g* and the center flat surface 41*h* is a flat plane parallel to the recording sheet transport direction plane T. In the elastic pressure member 41 shown in FIG. 8, the elastic pressure surface 41*a* has a pair of slant surfaces that rise by degrees from the ends toward the center thereof so that the elastic pressure surface 41*a* is closer to the fixing roller 31 at the center thereof than at the ends thereof such that the center portion projects toward the fixing roller 31 in the shape of arc, where the center and ends are along the axis direction of the fixing roller 31.

With the structure shown in FIG. 7 or FIG. 8 as well, in the state where the pressure belt 32 is in contact with the fixing roller 31 by the pressure, the pressure applied to the fixing roller 31 by the elastic pressure member 41 is greater at the center than at the ends, and the pressure applied to the fixing roller 31 by the hard pressure part 42*b* is greater at the ends than at the center, where the center and ends are along the axis direction of the fixing roller 31. Thus the transportation speed of the recording sheet S moving along the path length in the fixing nip N is faster at the ends than at the center, where the center and ends are along the axis direction of the fixing roller 31.

An experiment was conducted to check how wrinkles are generated when the recording sheet S passes through the fixing nip N in the fixing device 30, by varying the amount of projection of the elastic pressure surface 41*a* at the center and the ends thereof (the center and ends being along the axis direction of the fixing roller 31) in the state where the elastic pressure member 41 has been translated to separate from the fixing roller 31. For this experiment, the fixing roller 31 was formed as follows. The intermediate layer 31*b* made of silicon rubber and the surface layer 31*c* made of a fluorine-base tube were stacked, in the stated order, onto the core bar 31*a* that was cylindrical, made of iron, with thickness of 0.5 mm. The outer diameter of the fixing roller 31 was 26 mm. Also, the pressure belt 32 was prepared by forming a surface layer made of a fluorine-base tube onto the cylindrical base member made of polyimide, and then forming the base member with the surface layer into the cylindrical, endless shape. The base member with the surface layer was 260 mm wide and 0.1 mm thick, and the inner diameter of the pressure belt 32 was 30 mm.

The hard pressure member 42 of the pressure member 40 was formed as one unit from liquid-crystal polymer. The length of the hard pressure member 42 in the axis direction of the fixing roller 31 was 260 mm.

A standard shape of the elastic pressure member 41 was set as a rectangular solid whose length (thickness) in the direction perpendicular to the recording sheet transport direction plane T was 3.5 mm, and based on this shape, the amount of projection at the center (in the axis direction of the fixing roller 31) of the elastic pressure surface 41*a* was varied.

The pressure to be acted on the main pressure part 42*a* of the pressure member 40 was set to 0.1 MPa. The fixing nip N was formed in the range of 30 degrees of center angle from the circumferential surface of the fixing roller 31.

The first experiment (Experiment 1) was conducted under the condition that the main pressure part 42*a* of the hard pressure member 42 was in the shape of FIG. 3. For Experiment 1, five samples of the hard pressure member 42 were prepared. In the five samples of the hard pressure member 42, the center flat surface 42*h* of the supporting surface 42*d* of the main pressure part 42*a* was 90 mm long in the axis direction of the fixing roller 31, and the difference in height between the end flat surfaces 42*g* and the center flat surface 42*h* (the amount of projection) was 0.1 mm, 0.2 mm, 0.3 mm, 0.4 mm, and 0.5 mm, respectively. Experiment 1 was conducted to check how wrinkles are generated when the recording sheet S passes through the fixing nip N, with respect to the fixing device 30 including the above-described hard pressure member 42.

Also, for comparison, the check on how wrinkles are generated when the recording sheet S passes through the fixing nip N was made with respect to a fixing device in which the supporting surface 42*d* of the main pressure part 42*a* was flat in its entirety (the amount of projection was zero). The results of the experiment are shown in the table of FIG. 9.

The results of the experiment are as follows. When the amount of projection was "0", the rate of occurrence of wrinkle in the recording sheet S was 3% or more, which is unfavorable from a practical point of view (this is represented by the sign "x" in the table of FIG. 9). When the amount of projection was 0.1 mm, the difference between the center portion and the end portions (in the axis direction of the fixing roller 31) in the transportation speed of the recording sheet S moving along the path length in the fixing nip N was approximately 0.1% and the rate of occurrence of wrinkle was less than 3%, which is acceptable from a practical point of view (this is represented by the sign "Δ" in the table of FIG. 9). When the amount of projection was 0.2 mm, 0.3 mm, 0.4 mm, or 0.5 mm, the difference between the center portion and the end portions (in the axis direction of the fixing roller 31) in the transportation speed of the recording sheet S moving along the path length in the fixing nip N was approximately 0.2%, 0.3%, 0.4%, or 0.5%, respectively, and the occurrence of wrinkle was not observed, which shows a satisfactory result (this is represented by the sign "○" in the table of FIG. 9).

The second experiment (Experiment 2) was conducted under the condition that the main pressure part 42*a* of the hard pressure member 42 was in the shape of FIG. 6. More specifically, the supporting surface 42*d* of the main pressure part 42*a* projected toward the fixing roller 31 at the center thereof in the shape of arc for 120 mm in the axis direction of the fixing roller 31. For Experiment 2, five samples of the hard pressure member 42 were prepared. In the five samples of the hard pressure member 42, the amount of projection (at the largest) was 0.1 mm, 0.2 mm, 0.3 mm, 0.4 mm, and 0.5 mm, respectively. Experiment 2 was conducted in a similar manner to Experiment 1.

The results of Experiment 2 are as follows. When the amount of projection was 0.1 mm or 0.2 mm, the rate of occurrence of wrinkle was less than 3%; and when the amount of projection was 0.3 mm, 0.4 mm, or 0.5 mm, the occurrence of wrinkle was not observed.

The third experiment (Experiment 3) was conducted under the condition that the elastic pressure member 41 was in the shape of FIG. 7. More specifically, the elastic pressure surface 41*a* of the elastic pressure member 41 projected toward the fixing roller 31 at the center thereof for 90 mm in the axis direction of the fixing roller 31. Otherwise, the experiment conditions were the same as in Experiment 1. The results of Experiment 3 are as follows. When the amount of projection was 0.1 mm, the rate of occurrence of wrinkle was less than 3%; and when the amount of projection was 0.2 mm, 0.3 mm, 0.4 mm, or 0.5 mm, the occurrence of wrinkle was not observed.

The fourth experiment (Experiment 4) was conducted under the condition that the elastic pressure member 41 was in the shape of FIG. 8. More specifically, the elastic pressure surface 41*a* of the elastic pressure member 41 projected toward the fixing roller 31 at the center thereof in the shape of arc for 120 mm in the axis direction of the fixing roller 31. Otherwise, the experiment conditions were the same as in Experiment 1. The results of Experiment 4 are as follows. When the amount of projection was 0.1 mm or 0.2 mm, the rate of occurrence of wrinkle was less than 3%; and when the amount of projection was 0.3 mm, 0.4 mm, or 0.5 mm, the occurrence of wrinkle was not observed.

As described above, with regard to the fixing device 30 in which the fixing nip N is formed between the fixing roller 31 and the pressure belt 32 while the pressure belt 32 is pressed by the pressure member 40 to be in contact with the fixing roller 31 whose surface is elastically deformable, when the fixing device 30 is structured such that the center portion of the elastic pressure member 41 is closer, by an appropriate slight distance, to the fixing roller 31 than the end portions thereof (the center and ends being along the axis direction of the fixing roller 31) in the state where the elastic pressure surface 41*a* of the elastic pressure member 41 in the pressure member 40 has been translated to separate from the fixing roller 31, the transportation speed of the recording sheet S moving along the path length in the fixing nip N is faster at the end portions thereof than at the center portion thereof in the axis direction of the fixing roller 31. This makes it possible to prevent a wrinkle from being generated in the recording sheet S.

Furthermore, with this structure, it is possible to accurately adjust the difference between the end portions and the center portion in the axis direction of the fixing roller 31 in the transportation speed of the recording sheet S moving along the path length in the fixing nip N so that no wrinkle is generated in the recording sheet S, because, by slightly changing the amount of elastic deformation of the elastic pressure member 41 in the pressure member 40, the transportation speed of the recording sheet S becomes faster at the end portions thereof than at the center portion thereof in the axis direction of the fixing roller 31.

Furthermore, since the difference in the amount of elastic deformation of the fixing roller 31 is very small between the ends and the center thereof in the axis direction of the fixing roller 31, the amount of heat applied to the recording sheet S passing through the fixing nip N hardly changes in the width direction thereof. It is therefore possible to fix the toner image under the fixing condition that is substantially same along the width direction of the recording sheet S, thus providing a fixed image whose image quality is uniform in the axis direction of the fixing roller 31.

In the fixing device described above, the main pressure part 42*a* and the hard pressure part 42*b* of the hard pressure member 42 are formed as one unit from the same hard material so that the pressure applied to the main pressure part 42*a* is acted on the back surface side of the hard pressure part 42*b* and the elastic pressure member 41. However, the present invention is not limited to this structure, but may have a structure in which the main pressure part 42*a* is omitted, and the same pressure is acted on the back surface side of the hard pressure part 42*b* and the elastic pressure member 41.

Also, the image forming device, to which the fixing device of the present invention is applied, is not limited to the color printer, which is the case with the above-described embodiment, but may be any of a color image forming device and a monochrome image forming device such as a copier, a fax machine, and an MFP (Multiple Function Peripheral).

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

INDUSTRIAL APPLICABILITY

The present invention is applicable to a fixing device for fixing an image onto a recording sheet by applying heat and pressure to the recording sheet and the image thereon while the recording sheet is passing through a fixing nip which is formed between a fixing roller and a pressure belt while the fixing roller in rotation is brought into contact with the pressure belt by a pressure applied by a pressure member, and is able to prevent a wrinkle from being generated in the recording sheet without degrading the image quality fixed to the recording sheet.

What is claimed is:

1. A fixing device for fixing an image onto a recording sheet by applying heat and pressure to the recording sheet and the image thereon while the recording sheet is passing through a fixing nip, the fixing device comprising:

a pressure belt movable in a revolving motion;

a rotatable fixing roller; and a pressure member for pressing an inner circumferential surface of the pressure belt toward the fixing roller, the fixing nip being formed between the fixing roller and the pressure belt while an elastically deformable surface of the fixing roller in rotation is brought into contact with an outer surface of the pressure belt by a pressure applied by the pressure member to the inner circumferential surface of the pressure belt, the pressure member including:

an elastic pressure member for applying pressures to the fixing roller to cause a pressure distribution in which a greater pressure is applied to a center of the fixing roller than to each of ends thereof, the center and the ends being along an axis direction of the fixing roller; and a hard pressure member that is disposed parallel to the elastic pressure member on downstream side of the elastic pressure member in a direction of the revolving motion of the pressure belt and applies pressures to the fixing roller to cause a pressure distribution in which a greater pressure is applied to each of the ends of the fixing roller than to the center of the fixing roller, and a main pressure part that has a supporting surface supporting the elastic pressure member, the supporting surface has a shape in which the supporting surface rises from ends thereof toward a center thereof to form a projection so that the center is closer to the fixing roller than the ends, the center and the ends being along the axis direction of the fixing roller, and the elastic pressure member is in a shape of plane- parallel plates and deforms following the shape of the supporting surface when the elastic pressure member is in the state of not pressing the fixing roller.

2. The fixing device of claim 1, wherein an urging force toward the fixing roller is acted on the elastic pressure member and the hard pressure member, and by the urging force, the elastic pressure member deforms elastically when pressed against the fixing roller and the fixing roller deforms elastically when pressed by the hard pressure member so that the pressures applied by the elastic pressure member and the hard pressure member cause the respective pressure distributions.

3. The fixing device of claim 2, wherein the main pressure part causes the urging force to act on both of the elastic pressure member and the hard pressure member.

4. The fixing device of claim 3, wherein the main pressure part and the hard pressure member have been formed as one unit.

5. The fixing device of claim 3, wherein the main pressure part has a flat supporting surface supporting the elastic pressure member, and the elastic pressure member has a shape of projection so that a center portion thereof is closer to the fixing roller than end portions thereof when the elastic pressure member is in a state of not pressing the fixing roller, wherein the center portion and the end portions are along the axis direction of the fixing roller.

6. The fixing device of claim 1, wherein the elastic pressure member has a projection so that a center portion thereof is closer to the fixing roller than end portions thereof when the elastic pressure member is in a state of not pressing the fixing roller, wherein the center portion and the end portions are along the axis direction of the fixing roller, and the elastic pressure member deforms elastically following a shape of an outer circumferential surface of the fixing roller when the elastic pressure member is in a state of pressing the fixing roller.

7. The fixing device of claim 6, wherein the elastic pressure member has a shape of projection in which the elastic pressure member rises step by step like a staircase from ends thereof toward a center thereof so that the center portion is closer to the fixing roller than to the end portions when the elastic pressure member is in the state of not pressing the fixing roller.

8. The fixing device of claim 6, wherein the elastic pressure member has a pair of slant surfaces that face toward the fixing roller and rise by degrees from the ends toward the center so that the center portion is closer to the fixing roller than to the end portions when the elastic pressure member is in the state of not pressing the fixing roller.

9. The fixing device of claim 6, wherein a difference in height between the center portion and the end portions of the elastic pressure member is in a range from 0.1 mm to 0.6 mm inclusive.

10. An image forming device comprising an imaging forming part for forming an image and transferring the image on a recording sheet and a fixing device for fixing an image onto the recording sheet by applying heat and pressure to the recording sheet and the image thereon while the recording sheet is passing through a fixing nip, the fixing device including:

a pressure belt movable in a revolving motion;

a rotatable fixing roller; and a pressure member for pressing an inner circumferential surface of the pressure belt toward the fixing roller, the fixing nip being formed between the fixing roller and the pressure belt while an elastically deformable surface of the fixing roller in rotation is brought into contact with an outer surface of the pressurebelt by a pressure applied by the pressure member to the inner circumferential surface of the pressure belt, the pressure member including:

an elastic pressure member for applying pressures to the fixing roller to cause a pressure distribution in which a greater pressure is applied to a center of the fixing roller than to each of ends thereof, the center and the ends being along an axis direction of the fixing roller; and a hard pressure member that is disposed parallel to the elastic pressure member on downstream side of the elastic pressure member in a direction of the revolving motion of the pressure belt and applies pressures to the fixing roller to cause a pressure distribution in which a greater pressure is applied to each of the ends of the fixing roller than to the center of the fixing roller, and a main pressure part that has a supporting surface supporting the elastic pressure member, the supporting surface has a shape in which the supporting surface rises from ends thereof toward a center thereof to form a projection so that the center is closer to the fixing roller than the ends, the center and the ends being along the axis direction of the fixing roller, and the elastic pressure member is in a shape of plane-parallel plates and deforms following the shape of the supporting surface when the elastic pressure member is in the state of not pressing the fixing roller.

11. The image forming device of claim 10, wherein an urging force toward the fixing roller is acted on the elastic pressure member and the hard pressure member, and by the urging force, the elastic pressure member deforms elastically when pressed against the fixing roller and the fixing roller deforms elastically when pressed by the hard pressure member so that the pressures applied by the elastic pressure member and the elastic pressure member cause the respective pressure distributions.

12. The fixing device of claim 11, wherein the main pressure part causes the urging force to act on both of the elastic pressure member and the hard pressure member.

13. The image forming device of claim 12, wherein the main pressure part and the hard pressure member have been formed as one unit.

14. The image forming device of claim 12, wherein the main pressure part has a flat supporting surface supporting the elastic pressure member, and the elastic pressure member has a shape of projection so that a center portion thereof is closer to the fixing roller than end portions thereof when the elastic pressure member is in a state of not pressing the fixing roller, wherein the center portion and the end portions are along the axis direction of the fixing roller.

15. The image forming device of claim 10, wherein the elastic pressure member has a projection so that a center portion thereof is closer to the fixing roller than end portions thereof when the elastic pressure member is in a state of not pressing the fixing roller, wherein the center portion and the end portions are along the axis direction of the fixing roller, and the elastic pressure member deforms elastically following a shape of an outer circumferential surface of the fixing roller when the elastic pressure member is in a state of pressing the fixing roller.

16. The fixing device of claim 15, wherein the elastic pressure member has a shape of projection in which the elastic pressure member rises step by step like a staircase from ends thereof toward a center thereof so that the center portion is closer to the fixing roller than to the end portions when the elastic pressure member is in the state of not pressing the fixing roller.

17. The fixing device of claim 15, wherein the elastic pressure member has a pair of slant surfaces that face toward the fixing roller and rise by degrees from the ends toward the center so that the center portion is closer to the fixing roller than to the end portions when the elastic pressure member is in the state of not pressing the fixing roller.

18. The image forming device of claim 15, wherein a difference in height between the center portion and the end portions of the elastic pressure member is in a range from 0.1 mm to 0.6 mm inclusive.

* * * * *